US008544534B2

(12) United States Patent
Partouche et al.

(10) Patent No.: US 8,544,534 B2
(45) Date of Patent: Oct. 1, 2013

(54) POWER SYSTEMS FOR WIRELINE WELL SERVICE USING WIRED PIPE STRING

(75) Inventors: Ashers Partouche, Richmond, TX (US); Harold Steven Bissonnette, Sugar Land, TX (US); Shyam B. Mehta, Missouri City, TX (US); Reza Taherian, Sugar Land, TX (US); Gbenga Onadeko, Sugar Land, TX (US); Shardul Sarhad, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 664 days.

(21) Appl. No.: 12/722,619

(22) Filed: Mar. 12, 2010

(65) Prior Publication Data

US 2010/0236777 A1 Sep. 23, 2010

Related U.S. Application Data

(60) Provisional application No. 61/161,587, filed on Mar. 19, 2009.

(51) Int. Cl.
*E21B 47/00* (2012.01)

(52) U.S. Cl.
USPC ..... 166/65.1; 166/254.2; 166/66

(58) Field of Classification Search
USPC ..... 166/250.01, 65.1, 254.2, 66
See application file for complete search history.

(56) References Cited

U.S. PATENT DOCUMENTS

| | | | | |
|---|---|---|---|---|
| 4,518,888 | A | 5/1985 | Zabcik | |
| 4,806,928 | A | 2/1989 | Veneruso | |
| 5,433,276 | A | 7/1995 | Martain et al. | |
| 5,443,129 | A * | 8/1995 | Bailey et al. | 175/45 |
| 5,521,592 | A | 5/1996 | Veneruso | |
| 6,092,416 | A | 7/2000 | Halford et al. | |
| 6,174,001 | B1 | 1/2001 | Enderle | |
| 6,641,434 | B2 | 11/2003 | Boyle et al. | |
| 6,768,214 | B2 | 7/2004 | Schultz et al. | |
| 7,134,493 | B2 | 11/2006 | Runia | |
| 7,199,480 | B2 | 4/2007 | Fripp et al. | |
| 7,208,845 | B2 | 4/2007 | Masters et al. | |
| 7,242,103 | B2 | 7/2007 | Tips | |
| 7,537,051 | B1 | 5/2009 | Hall et al. | |
| 2006/0225926 | A1 | 10/2006 | Madhavan et al. | |
| 2008/0245570 | A1 * | 10/2008 | Partouche | 175/48 |

* cited by examiner

*Primary Examiner* — Brad Harcourt
(74) *Attorney, Agent, or Firm* — Kimberly Ballew

(57) ABSTRACT

A wellbore instrument system includes a pipe string extending from earth's surface to a selected depth in a wellbore. The pipe string includes at least one of an electrical conductor and an optical fiber signal channel. A power sub including an electric power source is coupled proximate a lower end of the pipe string. At least one electrically powered wireline configurable wellbore instrument is coupled to the power source in the sub.

10 Claims, 7 Drawing Sheets

POWER SYSTEMS FOR WIRELINE WELL SERVICE USING WIRED PIPE STRING

BACKGROUND OF THE INVENTION

1. Field of the Invention

The invention relates generally to the field of wellbore instruments and well logging methods. More specifically, the invention relates to systems and methods for operating electrically powered instruments in a well using a wired pipe string as a signal communication channel.

2. Background Art

Well logging instruments are devices configured to move through a wellbore drilled through subsurface rock formations. The devices include one or more sensors and other devices that measure various properties of the subsurface rock formations and/or perform certain mechanical acts on the formations, such as drilling or percussively obtaining samples of the rock formations, and withdrawing samples of connate fluid from the rock formations. Measurements of the properties of the rock formations made by the sensors may be recorded with respect to the instrument axial position (depth) within the wellbore as the instrument is moved along the wellbore. Such recording is referred to as a "well log."

Well logging instruments can be conveyed along the wellbore by extending and withdrawing an armored electrical cable ("wireline"), wherein the instruments are coupled to the end of the wireline. Such conveyance relies on gravity to move the instruments into the wellbore. Extending and withdrawing the wireline may be performed using a winch or similar spooling device known in the art. However, gravity can only be used on substantially vertical wellbores. Those deviating from vertical require additional force to move through the wellbore.

There are several types of wireline instrument conveyance known in the art for the foregoing conditions. One conveyance technique includes coupling the wireline instruments to the end of a coiled tubing having a wireline disposed therein. The wireline instruments are extended into and withdrawn from the wellbore by extending and retracting the coiled tubing, respectively. A subset of such coiled tubing techniques includes preliminary conveyance of the wireline configurable well logging instruments to a selected depth in the wellbore using a threadedly coupled pipe "string." See, for example, U.S. Pat. No. 5,433,276 issued to Martain et al. However, the use of coiled tubing with wireline instruments is costly and is inherently limited by the amount of pushing force capable with the coiled tubing. As a result, the use of coiled tubing is typically problematic in extended reach wells.

Another well logging instrument conveyance technique includes coupling wireline configurable well logging instruments to the end of a drill pipe or similar threadedly coupled pipe string. A wireline is coupled to the instruments using a "side entry sub" which provides a sealable passage from the exterior of the pipe string to the interior thereof. As the pipe string is extended into the wellbore, the wireline is extended by operating a conventional winch. An example of the foregoing is described in U.S. Pat. No. 6,092,416 issued to Halford et al. and assigned to the assignee of the present invention. However, this conveyance technique is frequently unreliable as the wireline is positioned in the annulus and subject to crushing, splicing or other damage. For example, the wireline may become pinched between the drill pipe and the casing or wellbore.

Additionally, the well logging instruments may be positioned at the end of a drill pipe without use of a wireline cable.

In such circumstances, each well logging instrument is provided with a battery and memory to store the acquired data. As a result, the well logging instruments cannot communicate with the surface while downhole. In addition, the data acquired cannot be analyzed at the surface until the wireline instruments return to the surface. Without any communication with the surface, surface operators cannot be certain the instruments are operating correctly, cannot control the instruments while downhole, and the data cannot be analyzed until after the wireline instruments are removed from the wellbore.

Recently, a type of drill pipe has been developed that includes a signal communication channel. See, for example, U.S. Pat. No. 6,641,434 issued to Boyle et al. and assigned to the assignee of the present invention. Such drill pipe, known as wired drill pipe, has in particular provided substantially increased signal telemetry speed for use with LWD instruments over conventional LWD signal telemetry, which typically is performed by mud pressure modulation or by very low frequency electromagnetic signal transmission.

The foregoing wired drill pipe having a signal communication channel has not proven effective at transmitting electrical power from the surface to an instrument string disposed at a lower end of the pipe. In wireline conveyance of wellbore instrument, electrical power is transmitted from the surface to the instruments in the wellbore using one ore more insulated electrical conductors in the wireline cable. In MWD and LWD, electrical power may be provided by batteries, or by an electric generator operated by flow of fluid through the pipe. When wired pipe is used for signal telemetry, the amount of electrical power required by the instruments may be substantially reduced because the signal telemetry device used in MWD/LWD, typically a mud flow modulator, uses a substantial portion of the total electrical power used by the instruments in the bottom hole assembly.

What is needed is a system and method for pipe conveyance of wellbore instruments that includes substantial signal telemetry capability, and does not require the use of armored electrical cable for continuous transmission of electrical power to the instruments in the wellbore or signal communication from the instruments to the surface.

DETAILED DESCRIPTION

The invention generally relates to devices for conveying a wellbore instrument or a "string" of such instruments through a wellbore using a wired pipe string, or wired drill pipe string, for conveyance and data communication uphole and/or downhole. The instrument string may include an electrical generator, battery, generator, power storage module or "sub" for supplying electrical power to operate the instrument string and for providing signal or data telemetry to a signal communication channel associated with the wired pipe string. The wired pipe string may be assembled and disassembled in segments to effect conveyance through a wellbore in a manner known in the art for conveyance of any type of segmented or jointed pipe through a wellbore.

In some examples as explained below, an instrument or a string of such instruments that can otherwise be conveyed through a wellbore using armored electrical cable ("wireline instrument string") can be coupled to one longitudinal end of a wired pipe string and extend into the wellbore below the end of the wired pipe string. Other examples can have the wireline instrument string partially or entirely disposed within an internal conduit or passage in the wired pipe string. The invention is equally applicable to any of the foregoing configurations.

Figure 1:
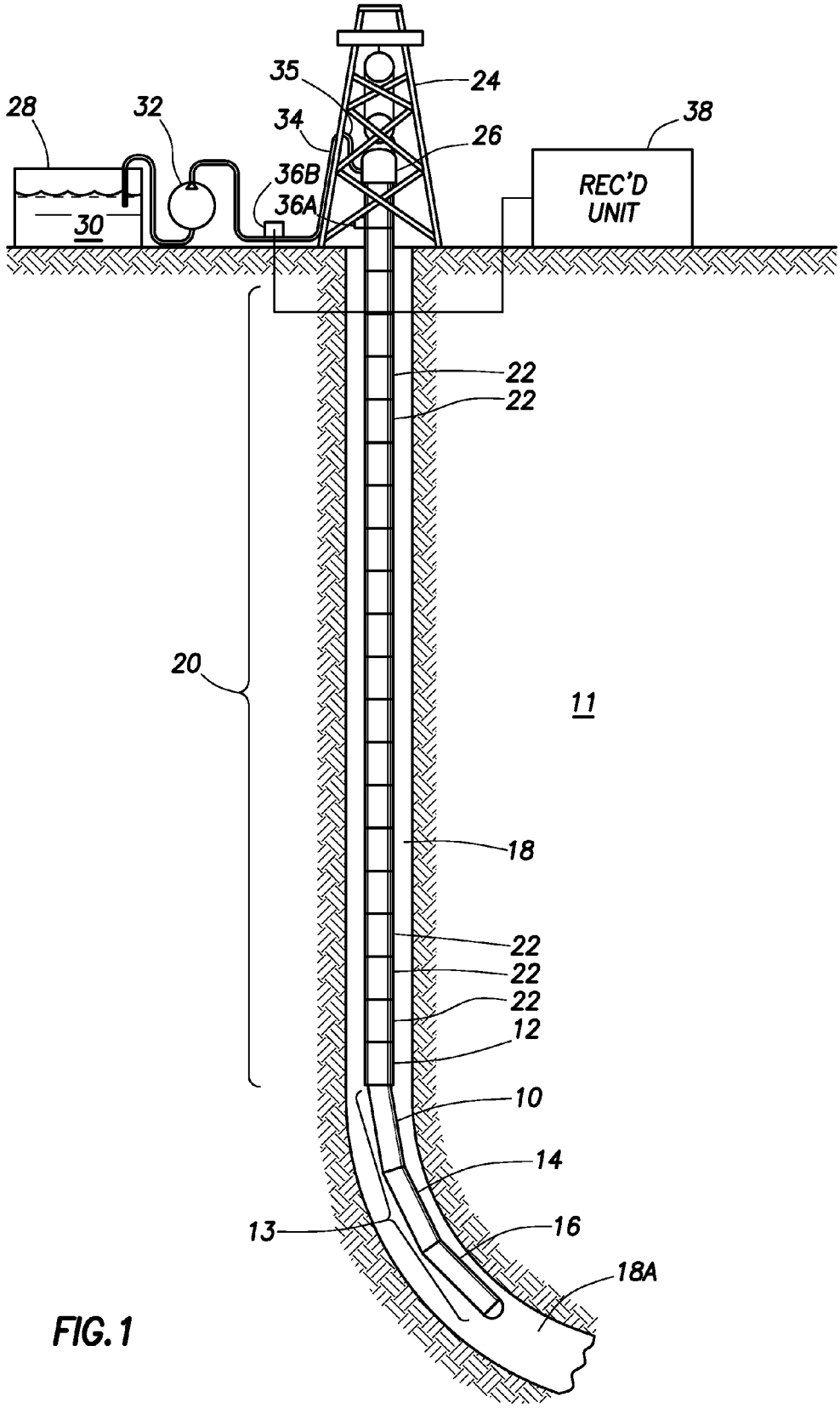
FIG. 1 illustrates an example of "wireline configurable" well logging instruments being conveyed through a wellbore using a wired pipe string in an embodiment of the present invention.

In FIG. 1, a drilling rig 24 or similar lifting device moves a wired pipe string 20 within a wellbore 18 that has been drilled through subsurface rock formations, shown generally at 11. The wired pipe string 20 may be extended into the wellbore 18 by threadedly coupling together end to end a number of segments ("joints") 22 of wired drill pipe. Wired drill pipe is structurally similar to ordinary drill pipe (see, e.g., U.S. Pat. No. 6,174,001 issued to Enderle) and includes a cable associated with each pipe joint that serves as a signal communication channel. The cable may be any type of cable capable of transmitting data and/or signals, such as an electrically conductive wire, a coaxial cable, an optical fiber or the like. Wired drill pipe typically includes some form of signal coupling to communicate signals between adjacent pipe joints when the pipe joints are coupled end to end as shown in FIG. 1. See, as a non-limiting example, U.S. Pat. No. 6,641,434 issued to Boyle et al. and assigned to the assignee of the present invention for a description of one type of wired drill pipe that can be used with the present invention. Each wired drill pipe joint is communicatively coupled to an adjacent wired drill pipe joint with the use of inductive couplers. However, the present invention should not be limited to the wired drill pipe string 20 and can include other communication or telemetry systems, including a combination of telemetry systems, such as a combination of wired drill pipe, mud pulse telemetry, electronic pulse telemetry, acoustic telemetry or the like.

The wired drill pipe string 20 may include one, or a plurality of coupled together wellbore instruments referred to as an instrument string 13 coupled to a lower end thereof. In the present example, the wellbore instrument string 13 may include various wireline configurable well logging instruments. As used in the present description, the term "wireline configurable well logging instrument" means a well logging or servicing instrument that can be conveyed through a wellbore using armored electrical cable ("wireline") or plain wire rope or line ("slickline"). Wireline configurable well logging instruments are thus distinguishable from "logging while drilling" ("LWD") instruments, which are configurable to be used during wellbore operations and form part of the pipe string itself. The purpose for coupling the wireline configurable logging instrument string 13 to the end of the wired pipe string 20 will be further explained below. LWD and related drill string instrumentation may also be used in addition to the wireline instrument string 13.

Several of the components disposed proximate the drilling unit 24 may be used to operate part of the system of the invention. These components will be explained with respect to their uses in drilling the wellbore to better enable understanding the invention, but it is to be understood that such components are used in wellbore operations other than drilling. Non-limiting examples of such other operations include "tripping", "reaming", "washing" and "circulating." In drilling, the pipe string 20 may be used to turn and axially urge a drill bit (not shown) into the bottom of the wellbore 18 to increase its length (depth). During drilling of the wellbore 18, a pump 32 lifts drilling fluid ("mud") 30 from a tank 28 or pit and discharges the drilling fluid 30 under pressure through a standpipe 34 and flexible conduit 35 or hose, through the top drive 26 and into an interior passage (not shown separately in FIG. 1) inside the pipe string 20. The drilling fluid 30 exits the drill string 20 through courses or nozzles (not shown separately) in the drill bit (not shown), where it then cools and lubricates the drill bit and lifts drill cuttings generated by the drill bit (not shown) to the Earth's surface.

When the wellbore 18 has been drilled to a selected depth, the pipe string 20 may be withdrawn from the wellbore 18, and an adapter sub 12 and the well logging instrument string 13 may be coupled to the lower end of the pipe string 20. The pipe string 20 may then be reinserted into the wellbore 18 so that the instruments 13 may be moved through, for example, a highly inclined portion 18A of the wellbore 18 which would be difficult to access using armored electrical cable ("wireline") to move the instruments 24. It is also known in the art to include a well logging instrument string within the pipe string, and cause the well logging instrument string to extend partially or completely out from the pipe string without the need to remove the pipe string from the wellbore. See, for example, U.S. Pat. No. 7,134,493 issued to Runia. Therefore, using the wireline instrument string according to the invention is not limited to prior withdrawal of the pipe string from the wellbore.

Advantageously with the use of pipes during well logging operations, in some examples the pump 32 may be operated to provide fluid flow to operate one or more turbines (explained below) in the well logging instrument string 13. The turbine (s) can provide power to operate certain devices in the well logging instrument string 13. As another example, the turbine (s) may be used to recharge batteries, fuel cell or other rechargeable power sources located either in a special power sub or in each individual instrument or tool.

In other examples, the wired pipe string 20 may be rotated to provide power to the well logging instrument string 13. For example, U.S. Pat. No. 7,537,051, which is hereby incorporated by reference in its entirety, discloses using rotation of the drill pipe to move a power generation element and induce an electrical current. The current generated in the '051 patent may be used to power the well logging instrument string 13 in an embodiment of the present invention. The current may also be used to recharge a battery or other rechargeable power source.

In yet another example, vibrational energy may be used to power the well logging instrument string 13, a rechargeable battery, and any other rechargeable power source. U.S. Pat. Nos. 4,518,888; 6,768,214; 7,199,480; 7,208,845; and 7,242,103 all discloses a system and/or method of converting vibrational energy into electrical power. Still in other examples, batteries may be used to operate the instrument string 13. Any types of batteries may be used as will be appreciated by those of ordinary skill in the art, including In a non-preferred embodiment, power may be transmitted downhole through the wired drill string 20, and, in such an embodiment, may be amplified or used to power or recharge a battery in the special power sub to provide power to the instruments. The foregoing examples of power provision may be used individually or in any combination.

As the well logging instrument string 13 is moved along the wellbore 18 by moving the pipe string 20 as explained above, signals detected by various sensors, non-limiting examples of which may include an induction resistivity instrument 16, a gamma ray sensor 14 and a formation fluid sample taking device 10 (which may include a fluid pressure sensor (not shown separately) are selected to be conveyed to a telemetry transceiver (FIG. 2) in the adapter sub 12 for communication along the signal channel in the wired pipe string 20. At the surface, a first telemetry transceiver 36A can be used to transmit and receive signals, such as wireless, between the communication channel in the wired pipe string 20 and a second telemetry receiver 36B that is in a fixed position. Thus, the wired pipe string 20 may be freely moved, assembled, disassembled and rotated without the need to make or break a wired electrical or optical signal connection. Signals from the second transceiver 36B, which may be electrical and/or optical signals, for example, may be conducted (such as by wire, fiber or cable) to a recording unit 38 for decoding and interpretation using techniques well known in the art. The decoded signals typically correspond to the measurements made by one or more of the sensors in the well logging instruments 10, 14, 16. Other sensors known in the art include, without limitation, density sensors, neutron porosity sensors, acoustic travel time or velocity sensors, seismic sensors, neutron induced gamma spectroscopy sensors and microresistivity (imaging) sensors.

The functions performed by the adapter sub 12 may include providing a mechanical coupling (explained below) between the lowermost threaded connection on the pipe string 20 and an uppermost connection on the well logging instruments 13. For example, the mechanical coupling may include a change in threads or pipe size from one end of the adapter sub 12 to the other end of the adapter sub 12. The adapter sub 12 may also include one or more devices (explained below) for producing electrical power to operate various parts of the well logging instruments 13. Finally, the adapter sub 12 may include signal processing and recording devices (explained below with reference to FIG. 2) for selecting signals from the well logging instrument string 13 for transmission to the surface using the channel in the wired pipe string 20 and recording some signals in a suitable storage or recording device (explained below) in the adapter sub 12.

It will be appreciated by those skilled in the art that in other examples the top drive 26 may be substituted by a swivel, kelly, kelly bushing and rotary table (none shown in FIG. 1) for rotating the pipe string 20 while providing a pressure sealed passage through the wired pipe string 20 for the drilling fluid 30. Accordingly, the invention is not limited in scope to use with top drive drilling systems.

The digital data handling rate (bandwidth) of wired pipe strings such as the one described in the Boyle et al. '434 patent may be about 1 million bits per second. As is known in the art, typical wireline configurable well logging instrument strings can generate signals at large multiples of the bandwidth of typical wired pipe strings. Accordingly, it is desirable to use the available wired pipe string bandwidth to communicate to the surface those signals from the well logging instrument string (13 in FIG. 1) that are most valuable to obtain substantially as they are measured (in "real time") or other predetermined data. Other data that is not typically valuable to obtain in real time may be stored in a local data storage device. It is also desirable to be able to change the particular signals transmitted to the surface in real time, as well as to change the sample rate of such real time transmission. For example, certain well logging measurements, such as induction resistivity corresponding to large lateral distance from the wellbore, change relatively slowly with change in axial position of the well logging instrument string. It may be possible to send such measurements to the surface at relatively slow rates, while measurements that change more rapidly (e.g. microresistivity measurements made for wellbore imaging) may be transmitted at much higher rates.

Figure 2:
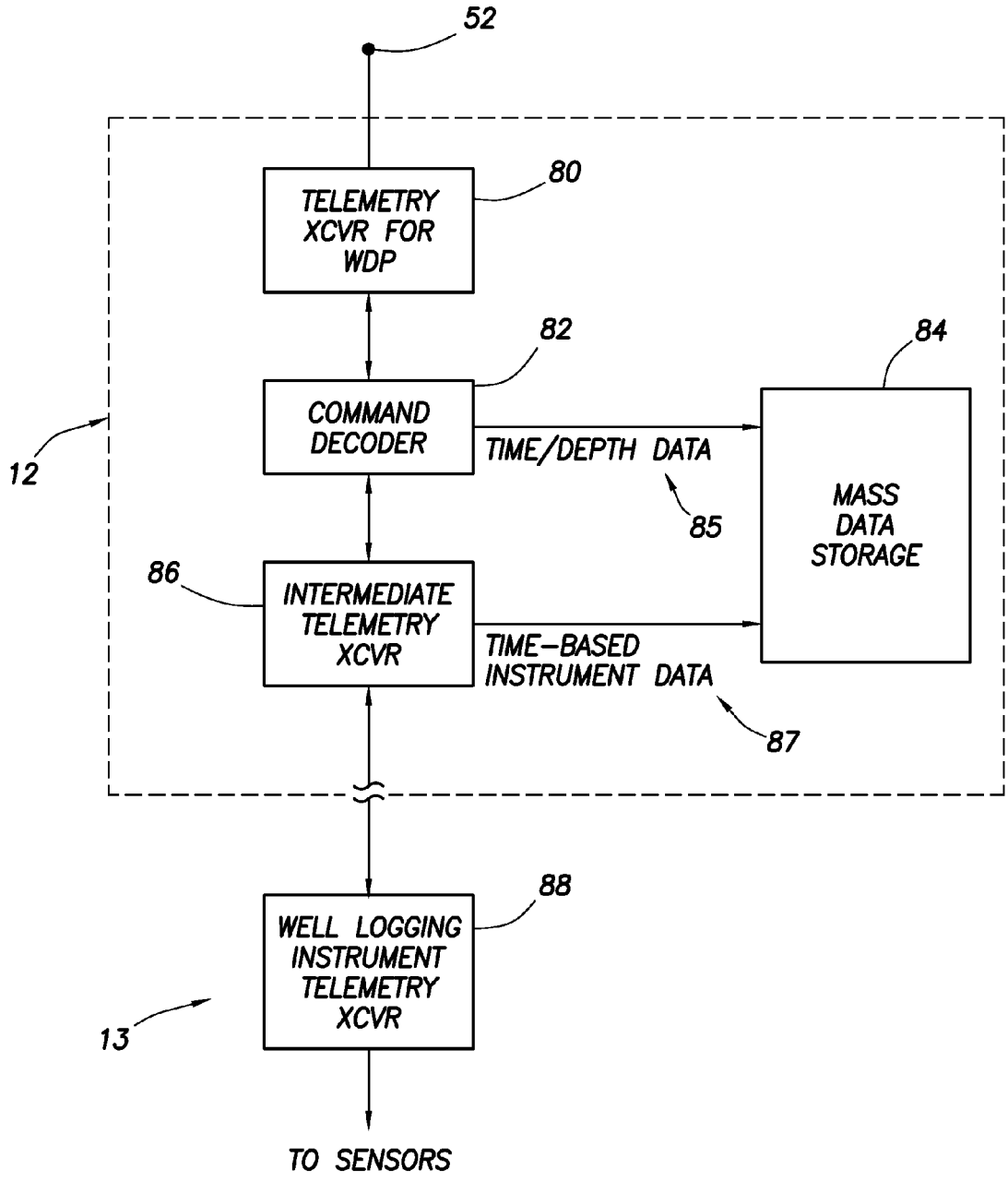
FIG. 2 illustrates an example of signal processing devices to adapt wireline configurable well logging instrument telemetry to wired pipe string telemetry in an embodiment of the present invention.

An example signal processing and recording unit disposed in or associated with the adapter sub 12 that can perform the foregoing telemetry conversion and formatting is shown in block diagram form in FIG. 2. A communication device 52 that couples signals to the signal communication channel in the wired pipe string (20 in FIG. 1) is in signal communication with a telemetry transceiver 80 ("WDP transceiver") configured to communicate signals in the telemetry format used for the wired pipe string (20 in FIG. 1). The WDP transceiver 80 is preferably bidirectional. A command decoder 82 may interrogate the telemetry signals from the WDP transceiver 80 to detect any commands originating from the recording unit (38 in FIG. 1). Such commands may include instructions to send different instrument measurement signals from the well logging instrument string (13 in FIG. 1) to the recording unit (38 in FIG. 1) over the wired pipe string. Another type of instruction that may be detected in the command decoder 82 is time/depth records. As the wired pipe string 20 is moved along the wellbore, the axial position in the wellbore (depth) of a reference point on the pipe string 20 or on the instrument string 13 may be used to indicate the depth of each instrument sensor in the instrument string 13. The depth is typically determined by measuring the elevation of the top drive (26 in FIG. 1) and adding to the elevation the length of all the individual components of the pipe string and instrument string. The measured depth can be adjusted for pipe stretch and/or compression based on weight-on-bit measurements, temperature measurements, pipe strain measurements and the like. For example, wired drill pipe allows various measurements to be taken along the drill string which may aid in effectively determining the depth. The elevation may be recorded automatically in the recording unit (38 in FIG. 1) by use of appropriate sensors on the drilling unit (24 in FIG. 1). The time/depth data may be used to generate a record with respect to depth of measurements made by the various sensors in the instrument string.

The command decoder 82 may transmit instructions to change the data sent over the wired pipe string 20 to an intermediate telemetry transceiver 86. The intermediate telemetry transceiver 86 receives well logging instrument measurements from the instrument string by signal connection to a well logging instrument telemetry transceiver 88 in the instrument string 13. The well logging instrument telemetry transceiver 88 may be the same type as used in any wireline configurable well logging instrument string, and is preferably configured to transmit signals over an armored electrical cable ("wireline") when the instrument string is deployed on a wireline. In the present example, all or substantially all well logging instrument signals that would be transmitted over the wireline if so connected may be communicated to the intermediate telemetry transceiver 86. Depending on the instruction from the surface some of the signals are communicated to the WDP telemetry transceiver 80 for communication over the wired pipe string 20. Remaining or all well logging instrument signals may be communicated to a data storage device 84 such as a solid state memory or hard drive. The data storage device 84 may also receive and store the same signals that are transmitted to the surface over the wired pipe string. The foregoing components, including the WDP telemetry 80, the data storage 84, the command decoder 82 and the intermediate telemetry 86 may be enclosed in the adapter sub 12 in some examples. In other examples, the foregoing components may be enclosed in a separate housing (not shown) that is itself coupled to the adapter sub 12 and to the instrument string 13.

Figure 3:
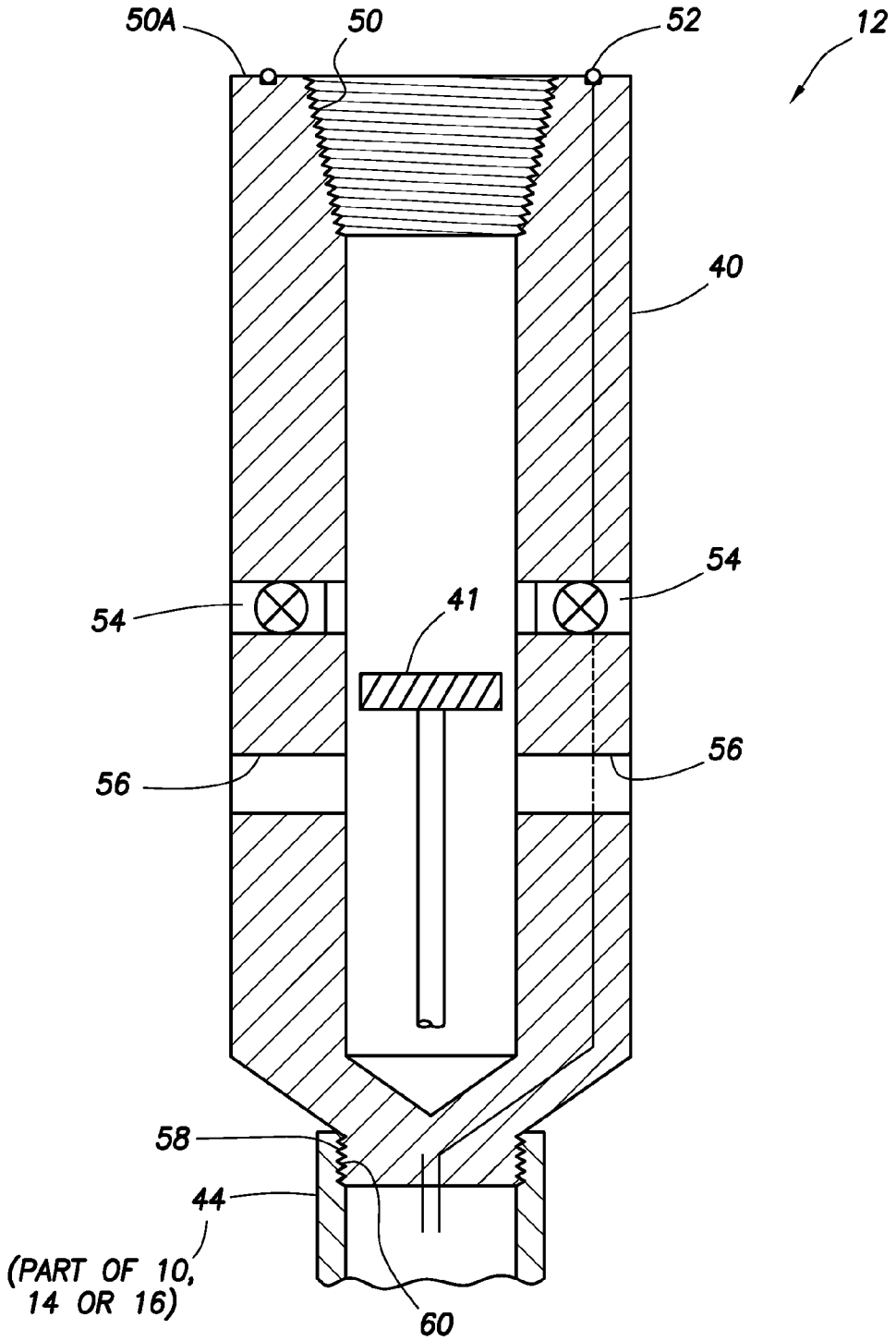
FIG. 3 shows one example of mechanical components of an adapter sub in an embodiment of the present invention.

One example of the adapter sub is shown in more detail in FIG. 3. The adapter sub 12 may include a housing 40 having an upper threaded connection 50 configured to couple to the lowermost threaded connection on the wired pipe string (20 in FIG. 1). The threaded connection 50 may include the communication device 52 (described with reference to FIG. 2) disposed in a groove or similar receptacle in the thread shoulder 50A of the upper threaded connection 50. The communication device 52 may be electromagnetic, as explained, for example, in the Boyle et al. patent referred to above. The housing 40 may include one or more controllable bypass valves 54. The controllable bypass valves 54 may be operated, for example, by solenoids (not shown) to selectively enable part of the fluid flow through the pipe string (20 in FIG. 1) to be diverted into the wellbore (18 in FIG. 1) above the turbine 41, thus reducing the output of the turbine 41 if desired. The housing 40 may include fixed discharge ports 56 below the turbine 41 to enable fluid flow to operate the turbine 41. Alternatively, the discharge ports 56 may be opened, closed and partially opened or closed via solenoids or other known devices. The bypass valves 54 and/or the discharge ports 56 may be controlled via control signals transmitted from a processor, processing device or other device at the Earth's surface to control the output of the turbine 41. The housing 40 may include a lower threaded connection 58 that is configured to couple to an upper threaded connection 60 in the well logging instrument string (13 in FIG. 1), shown as a telemetry module 44, although the particular well logging instrument that couples to the adapter sub 12 is not a limit on the scope of the present invention.

Figure 4:
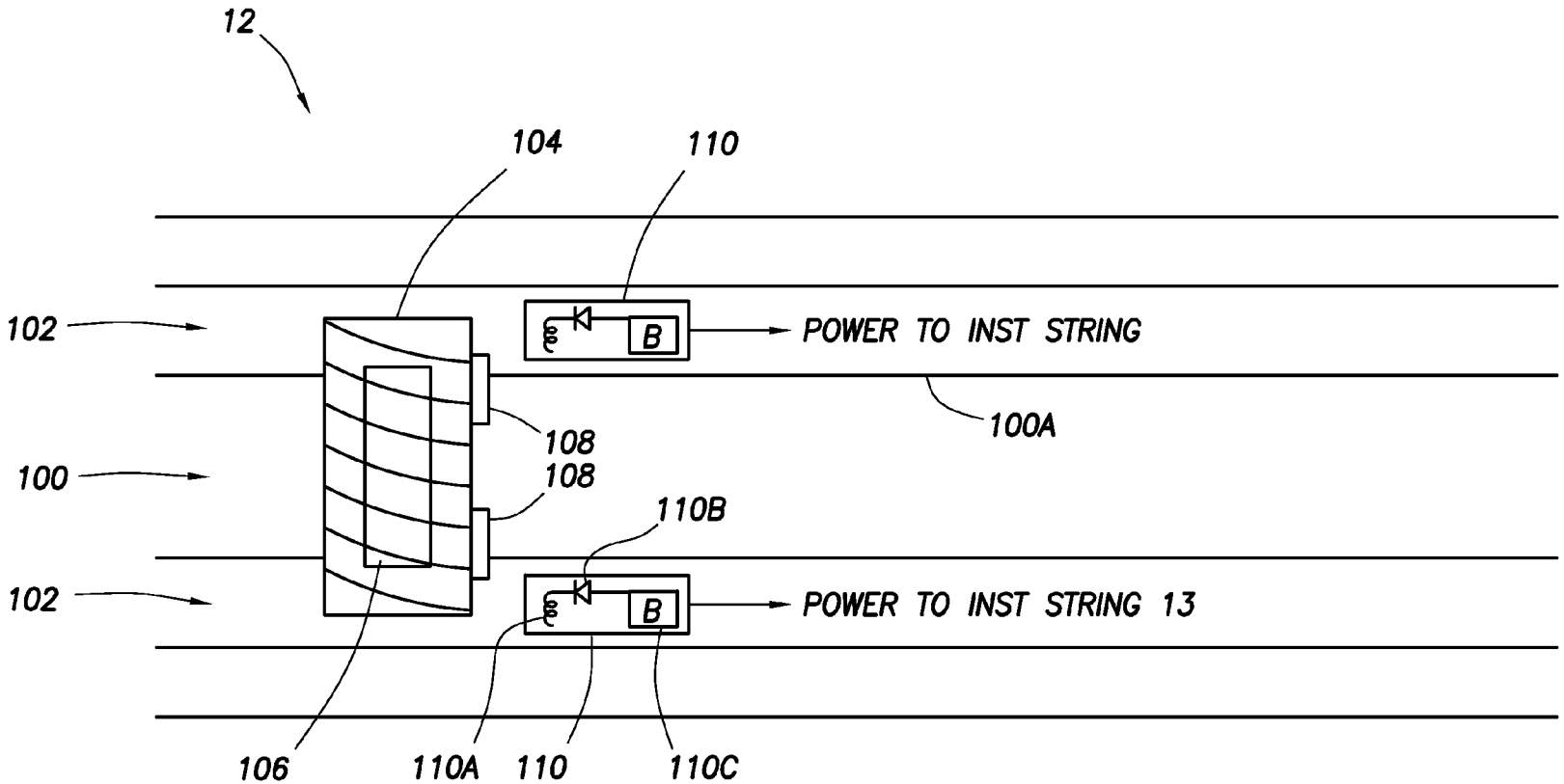
FIG. 4 shows an example adapter sub having an annular turbine in an embodiment of the present invention.

Another example of an adapter sub 12 is shown in cross sectional view in FIG. 4. The adapter sub 12 may include an internal conduit 100A that defines a central passage 100 through the interior of the sub 12. The passage in the conduit 100A enables certain tools (e.g., darts, balls, slickline devices, etc.) to be passed through the adapter sub 12. Such tools are ordinarily moved through the internal passage in the pipe string for certain wellbore operations. A turbine 104 may be disposed externally to the conduit 100A by being rotatably mounted on the conduit 100A such as by a bearing assembly 106. As in the example shown in FIG. 3, flow of drilling fluid may be diverted to the annular space 102 between the conduit 100A and the wall of the sub 12. The diverted flow can be used to operate the turbine 104. The turbine 104 may include magnets 108 on one longitudinal end. One or more generator modules 110 may be disposed in the annular space 102 between the conduit 100A and the wall of the adapter sub 12. The one or more generator modules 110 may be enclosed in a housing, such as a pressure resistant, non-ferromagnetic housing and may be made from, for example, stainless steel, monel or an alloy sold under the trademark INCONEL, which is a registered trademark of Huntington Alloys Corporation, Huntington, W.V. A generator coil 110A may be disposed in the housing and arranged to convert changing magnetic flux from the magnets 108 into electric current as the turbine 104 rotates. A rectifier 110B and energy storage device 110C such as a supercapacitor or battery may be connected to the rectifier to smooth the current and store electrical energy when the turbine 104 is rotating slowly, rotating at varying speeds or not at all (e.g., when drilling fluid circulation is stopped). Electrical output from the one or more generator modules 110 may be coupled to the instrument string (13 in FIG. 1) to operate the various electrical devices therein.

Figure 5:
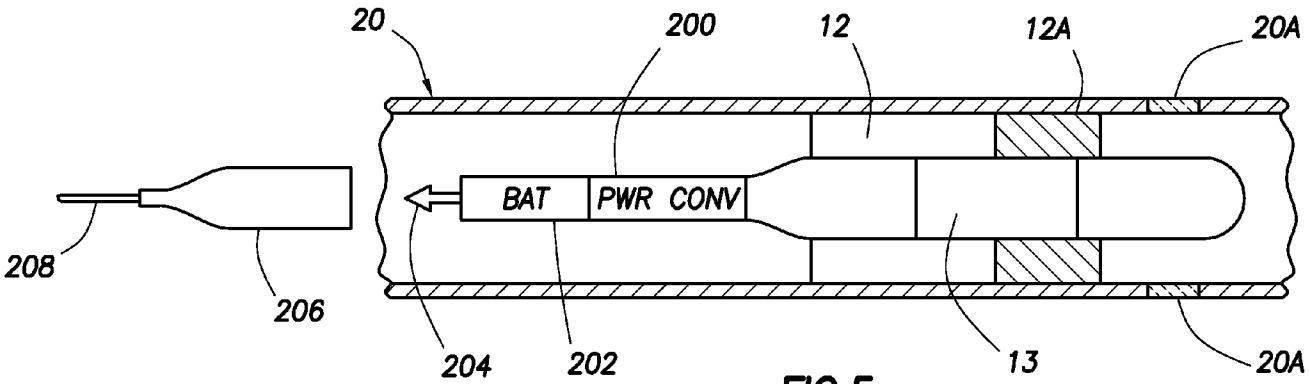
FIGS. 5 and 6 show examples of battery arrangements for powering well logging instruments in an embodiment of the present invention.
Figure 6:
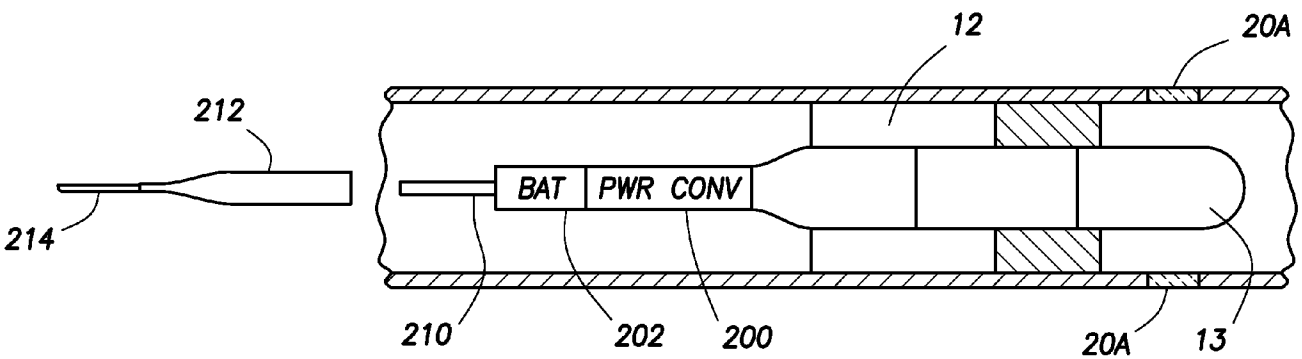

In other examples, the wireline well logging instrument string may be disposed partially or entirely inside the passage in the pipe string. Two such examples are shown in FIGS. 5 and 6. The example shown in FIG. 5 includes a landing seat 12A to engage and retain the exterior of the well logging instrument string 13 as it is moved to a selected position within the pipe string 20. Depending on the particular configuration, the wall of the pipe string 20 may include one or more energy transparent windows 20A such as may be made from acoustically or electromagnetically transparent material (e.g., plastic or glass) so that energy emitters and/or detectors (not shown) in the instrument string 13 may be in energy communication with the formations outside the wellbore.

The adapter sub 12 may be coupled to a power converter module 200 that converts the output of a battery 202 into a form suitable for operating the instrument string 13. In the example of FIG. 5, the battery 102 may be removable from the power converter module 200 without withdrawing the pipe string 20 from the wellbore. For example, the batter battery 102 may be removable from the power converter module 200 by engaging an overshot 206 onto a suitable fishing neck 204 coupled to the exterior of the 202 battery. The overshot 206 may be conveyed through the interior of the pipe string 20 using, for example, slickline 208, although the conveyance used for the overshot 206 is not intended to limit the scope of the present invention. When required, the battery 202 may be replaced by withdrawing it from the converter module 200 and inserting a new battery onto the converter module 200 using the overshot 206 and slickline. In another example, the battery 202 may include a terminal associated with the fishing neck 204 such that one or more additional batteries may be coupled to the top of the battery 202 in the instrument string to form a battery stack.

The example shown in FIG. 6 may have a battery 202 that is fixedly coupled to the power converter module 200. To recharge the battery 202, the battery 202 can include a charging terminal 210. A submersible, insulated electrical connector 212 may be conveyed into the interior of the pipe string 20 using an electrical cable, e.g., an armored electrical cable 214. The insertion continues until the connector 212 engages the charging terminal 210. Electrical power may be passed along the cable 214 to charge the battery 202. When charging is completed, the cable 214 and connector 212 may be withdrawn from the interior of the pipe string 20. Note that the foregoing battery configurations explained with reference to FIGS. 5 and 6 may also be used with the instrument string configuration and adapter sub configuration explained with reference to FIGS. 1, 2 and 3, wherein the instrument string 13 is disposed below the longitudinal end of the pipe string.

Figure 7:
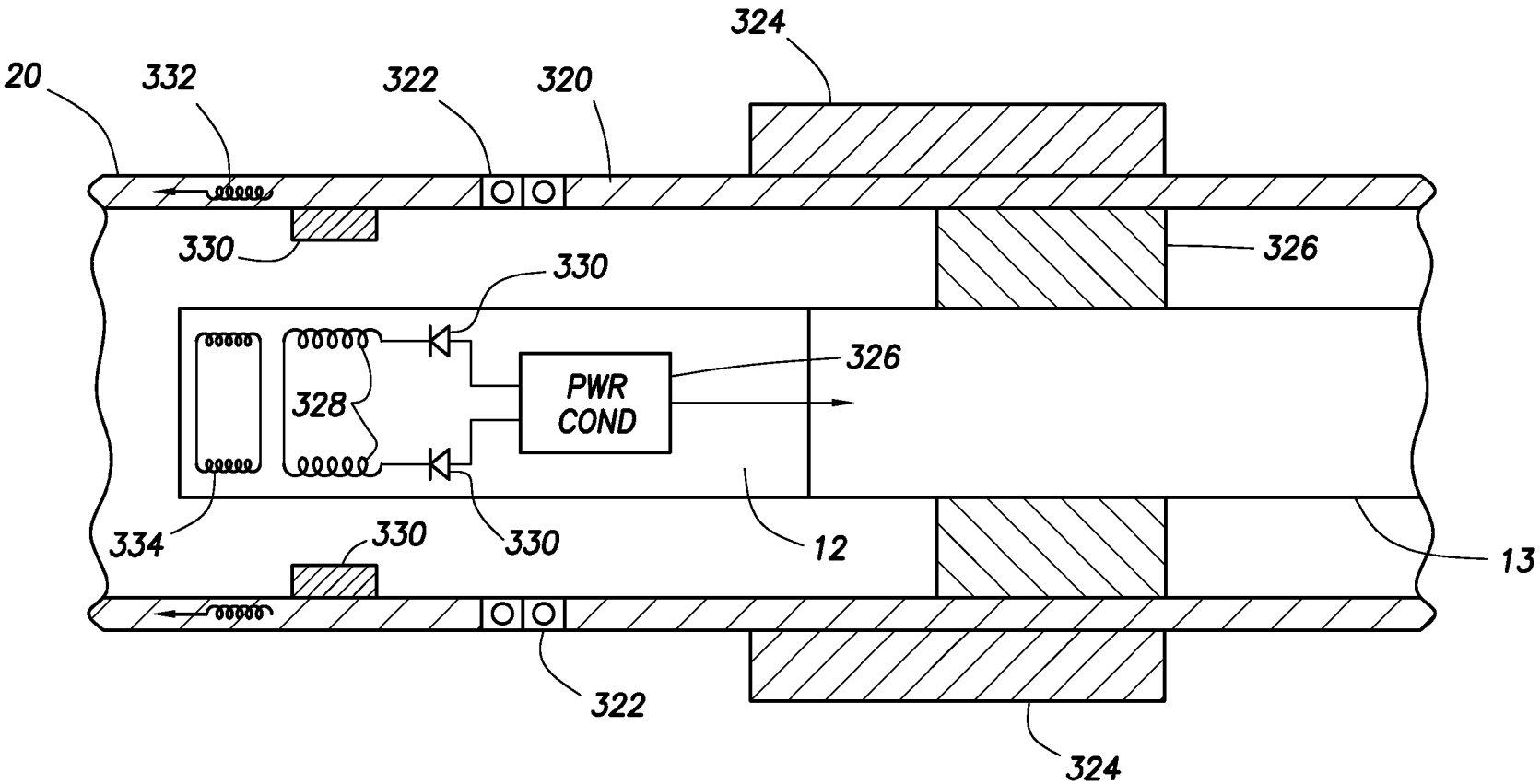
FIG. 7 shows an example adapter sub that uses pipe string rotation to generate power in an embodiment of the present invention.

Another example adapter sub is shown in FIG. 7 in which electric power for the well logging instrument string 13 can be generated by rotation of the pipe string 20. The pipe string 20 includes a bearing assembly 322 at its lower longitudinal end. One or more pipe joints 320 are coupled to the bearing assembly 322 such that the pipe string 20 may be rotated (see FIG. 1) from the surface or by using motor (not shown) operated by flow of drilling fluid ("mud motor"). The one or more pipe joints 320 may be rotationally fixed in the wellbore by including devices such as stabilizer blades 324, bow springs, extending pads or the like to resist rotation. Advantageously, with the use of wired drill pipe the stabilizer blades 324 may be operated, such as extending or retracting them by commands from the surface. Thus, when the drill string 20 is turned, the pipe joint(s) 320 below the bearing assembly 322 remain substantially rotationally fixed. The well logging instrument string 13 may be seated in a suitable fixture 326 such as explained with reference to FIGS. 5 and 6 disposed in the one or more pipe joints 320 below the bearing assembly 322. Therefore, the well logging instrument string 13 may be substantially rotationally fixed while the pipe string 20 is rotated. In the present example adapter sub 12 may include in its upper end alternator or generator coils 328. In such arrangement, the adapter sub 12 is preferably made from non-magnetic material as explained above. The alternator coils 328 may be coupled through respective rectifiers 330 to a combination battery/power conditioner 326. The power conditioner 326 provides electric power to operate the instrument string 330. The electric power is induced in the coils 330 by magnets 330 affixed to the inner surface of the pipe string 20 at a longitudinal position proximate the coils 330. In the present example, it may be desirable to make the joint of the pipe string proximate the bearing assembly 322 from non-magnetic material as well. Relative rotation between the pipe string 20 and the adapter sub 12 provides the electromagnetic induction.

The relative rotation between the pipe string 20 and the adapter sub 12 requires a signal communication link between the instrument string 13 and the communication channel in the pipe string 20 that may be operative through such relative rotation. In the present example, an induction coil 334 may be disposed in the adapter sub 12 longitudinally proximate a corresponding induction coil 332 in the pipe string 20. Such proximate induction coils 332, 334 may provide signal communication between the instrument string 13 and the pipe string 20. An inductive coupling such as the one described in U.S. Pat. Nos. 5,521,592 and 4,806,928 issued to Veneruso and assigned to the assignee of the present invention may be used in the pipe string and the adapter sub to effect signal communication.

Another example of the adapter sub 12 is shown in cross section in FIG. 2. The sub 12 may be made using a selected length drill collar 150 or similar pipe segment configured to be threadedly coupled into the drill string (20 in FIG. 1). The drill collar 150 may be made from non-magnetic allow such as monel, stainless steel or non-maganetic alloy sold under the trademark INCONEL, which is a registered trademark of Huntington Alloys Corporation, Huntington, W.V. The drill collar 150 may include a male threaded connector or "pin" 52 at one longitudinal end and a female threaded connector or "box" 54 at the other longitudinal end, or other suitable coupling to connect to wireline configurable well logging instruments (e.g., string 13 in FIG. 1). An internal thread shoulder 155 (shown in the box 154 in FIG. 2, but could also be in the pin 152) may include an electromagnetic coupling 164 for communicating electric power generated in the sub 12 to other components of the drill string (20 in FIG. 1), for example, MWD and LWD instruments, and wireline configurable instruments (see, e.g., 14 and 16 in FIG. 1). Such electromagnetic couplings are described, for example, in U.S. Patent Application Publication No. 2006/0225926 filed by Madhavan et al., the patent application for which is assigned to the assignee of the present invention. A corresponding electromagnetic coupling (not shown in FIG. 8) may be included in a corresponding pin thread shoulder (not shown) of the instrument (not shown) coupled into the box 154. Alternatively, an insulated galvanic electrode or contact (not shown) may be disposed in the thread shoulder 155 for transmitting electrical power directly rather than by electromagnetic induction.

The collar 150 may define an interior chamber 156 in which may be contained some or all of the active components of the generator portion of the sub 12. The chamber 156 may be enclosed, sealed and maintained substantially at surface atmospheric pressure by inserting a resilient metal tube 161 into an interior passage 148 in the collar 150. The tube 161 may be sealed against the interior of the collar 150 by o-rings 163 or other sealing elements. The tube 161 should have sufficient strength to resist bursting by reason of the pressure of mud (30 in FIG. 1) therein during drilling, but should also be resilient enough to enable communication of pressure variations in the mud (30 in FIG. 1) to a piezoelectric transducer (explained below) coupled to the exterior thereof. Suitable materials for the tube 161 may include steel, or copper beryllium alloy, the latter preferred if the tube 161 needs to be non-magnetic.

Figure 8:
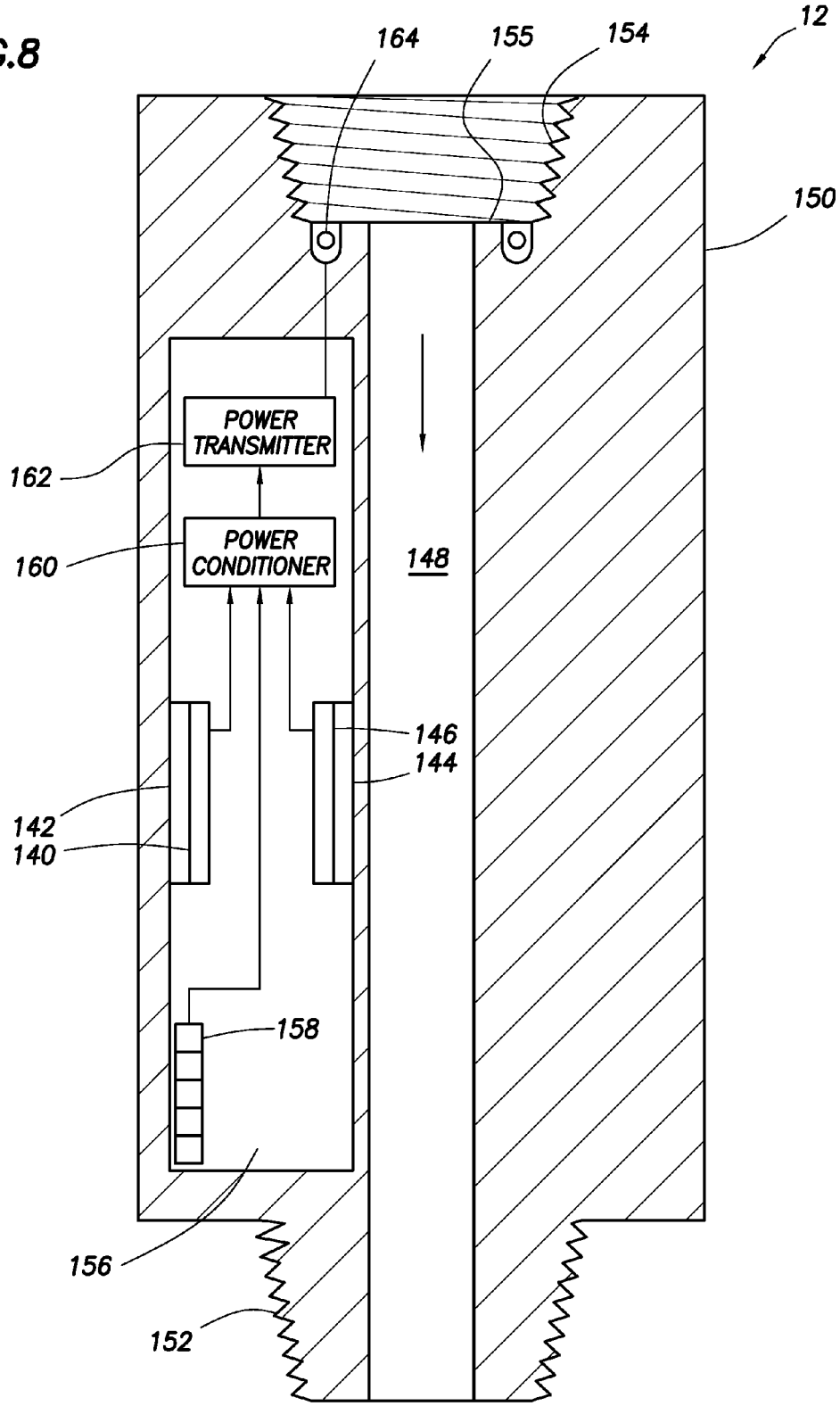
FIG. 8 shows an example power generator that uses energy of pipe motion to generate electric power in an embodiment of the present invention.

In the present example, the chamber 156 may include therein one or more piezoelectric transducers, shown at 158 and 146. The one or more piezoelectric transducers 158, 146 are arranged to undergo stress (and consequently develop a voltage thereacross) as a result of certain types of vibrations, such as lateral, axial or torsional, induced in the drill string (20 in FIG. 1). One of the piezoelectric transducers 146, 158, which may be referred to for convenience as a longitudinal transducer and which is shown at 158, may include a plurality of piezoelectric crystals stacked end to end, polarized in the direction of their thickness (along the longitudinal dimension of the drill collar 50), and coupled at one end of the stack to a lowermost surface in the chamber 156. Arranged as shown in FIG. 8, the longitudinal transducer 158 may be responsive to axial vibrations generated during drilling as the drill bit drills through the subsurface formations. Thus, the longitudinal transducer 158 may generate electric power from drill bit-induced or other axial vibrations induced in the drill string (20 in FIG. 1).

A second one of the piezoelectric transducers, shown at 146, may be made from a plurality of substantially planar piezoelectric crystals polarized in the direction of their thickness. The second transducer 146 may be coupled on one face to a metal protective shield 144, and the shield 144 placed in contact with an exterior surface of the tube 161 that is adjacent to the interior passage 148 for flow of drilling fluid (30 in FIG. 1). Arranged as shown in FIG. 8, the second transducer 146 may be responsive to vibrations in the drill string (20 in FIG. 1) caused by flow of the mud through the passage 148 in the collar 150. Vibrations induced in the collar 150 by the flow of mud (30 in FIG. 1) may thus result in electric power generation by the second transducer 146.

A third piezoelectric transducer 140 may be enclosed in elastomer 142 such as rubber to exclude fluid therefrom while enabling the transducer 140 to remain sensitive to pressure variations in the ambient environment. The third transducer 140 may be disposed in a recess 141 formed on the exterior of the collar 150. The third transducer 140 may be electrically coupled to circuits in the chamber 156 using a pressure-sealed electrical feedthrough 165 of types well known in the art to exclude fluid from entering the chamber 156. Arranged as shown in FIG. 8, the third transducer 140 may generate electric power by reason of lateral vibrations induced in the drill string (20 in FIG. 1) and/or by reason of vibrations created by pressure variations in mud flowing in an annular space (FIG. 1) between the exterior of the drill string (20 in FIG. 1) and the wall of the wellbore.

In some examples, the piezoelectric materials used to make the transducers may be crystals or ceramics with high dielectric constants, high sensitivity, and high electro-mechanical constants. Examples of the foregoing include lead zirconate titanate (PZT) type ceramics with extremely high dielectric constant and high coupling coefficients, and piezoelectric single crystals lead magnesium niobate-lead titanate (PMN- PT) and lead zirconate niobate-lead titanate (PZN-PT), which both have extremely high charge constants, high electro-mechanical coupling coefficients and high dielectric constants.

The electrical output of each of the transducers 158, 146, 140 may be coupled to power conditioning circuits 160 disposed within the chamber 156. The power conditioning circuits 160 may include suitable switching, rectification and energy storage elements (e.g., capacitors, not shown separately) so that electric power generated by the transducers is stored and made available for other components of the drill string. A power transmitter 162 may be used to convert electric power stored in the storage elements (e.g., a capacitor bank—not shown) in the power conditioning circuits 160 to suitable alternating current for transmission using the electromagnetic coupling 164. The power transmitter 162 may be omitted if the electric power is communicated directly through a galvanic electrode (not shown). The example transducers shown in FIG. 8 are only displayed on opposed sides of the collar 50 for purposes of clarity of the illustration, however. In some examples, a plurality of circumferentially segmented transducers 158, 146, 140 may be disposed around substantially the entire circumference of the associated surfaces described above within the chamber 156 and on the exterior of the collar 150.

The invention as explained above may be used in conjunction with a number of other drilling and measurement devices known in the art. Non-limiting examples of such other devices may include the following. The wireline configurable well logging instruments may be inserted into a sleeve or a drill collar to protect them from being damaged during rotation and/or lateral movement, and can enable fluid pumped from the surface to flow around them for cooling purposes.

A sleeve or drill collar may cover less than the entire string of well logging instruments, thus allowing sections of the instrument string to come into direct contact with the formations (11 in FIG. 1) for measurement or sample extraction purposes.

A drill bit may be added at the bottom of the instrument string to allow drilling to continue while logging or between logging/sampling operations in conjunction with a drilling motor. The motor and/or a rotary steerable directional drilling system may be included between the drill bit and the well logging instruments to improve drilling efficiency and allow controlling the trajectory of the wellbore (18 in FIG. 1).

Logging while drilling ("LWD") and/or measurement while drilling ("MWD") instruments known in the art may be included at any location in the wired pipe string (20 in FIG. 1) to enable alternative measurements, or as a contingency to the failure of the well logging instrument string or failure of communication using the wired pipe string.

Stabilizers, reamers or wear bands may be placed on the foregoing sleeve or on a drill collar for directional control, wellbore conditioning, hole opening or other reasons.

Existing measurement while drilling telemetry technology (mud pressure modulation telemetry) may be used as two way communication with the surface instead of wired drill pipe or as a contingency to the failure of the wired drill pipe.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A wellbore instrument system, comprising:

a pipe string extending from earth's surface to a selected depth in a wellbore, the pipe string comprising wired drill pipe communicatively coupled at each joint;

an adapter sub coupled to the pipe string proximate a lower end of the pipe string, the adapter sub including a source of electric power therein; and at least one wireline configurable wellbore instrument coupled to the adapter sub on an opposite side of the pipe string, wherein the source of electric power includes a turbine for converting flow of fluid through the pipe string into power to operate the at least one wireline configurable wellbore instrument, wherein the adapter sub has bypass valves positioned above the turbine providing fluid communication between an interior of the adapter sub and an annulus external to the adapter sub.

2. The system of claim 1 wherein the turbine recharges a rechargeable battery capable of providing electric power to the at least one wireline configurable wellbore instrument.

3. The system of claim 1 wherein the bypass valves are controlled with control signals transmitted via the wired drill pipe.

4. The system of claim 1 wherein the turbine is functionally coupled to an electric generator.

5. The system of claim 1 wherein the turbine is positioned in an interior of the adapter sub and is connected to a generator coil positioned within a housing of the adapter sub.

6. A method for well logging, comprising:

moving at least one wireline configurable wellbore instrument along a wellbore at one end of a segmented pipe string, the pipe string including a communication channel associated therewith;

providing electrical power proximate a downhole end of the segmented pipe string via a turbine to operate the wellbore instrument;

communicating measurements from at least one sensor in the instrument to the signal communication channel;

detecting the communicated measurements proximate a surface end of the communication channel; and controlling at least one bypass valve positioned above the turbine, wherein controlling the at least one bypass valve controls electrical power output by the turbine.

7. The method of claim 6 wherein the providing electrical power includes converting flow of fluid through the pipe string into power to operate the at least one wireline configurable wellbore instrument.

8. The method of claim 7 wherein the converting comprises rotating a generator.

9. The method of claim 7 wherein the converting comprises rotating a turbine, the rotating including adjusting a response of the turbine to compensate for power load imparted by the at least one wireline configurable wellbore instrument.

10. The method of claim 6 wherein the providing comprises rotating the pipe string relative to the wellbore instrument to induce electric power in generator coils disposed in the instrument.

* * * * *